US007677940B1

(12) United States Patent
Nazarian

(10) Patent No.: US 7,677,940 B1
(45) Date of Patent: Mar. 16, 2010

(54) SWIMMER'S SAFETY APPARATUS

(76) Inventor: Reza Nazarian, Flat 36 Woodfield Lodge, Woodfield Road, Crawley (GB) RH10 8AH ( * ) Notice: Subject to any disclaimer, the term of this patent is extended or adjusted under 35 U.S.C. 154(b) by 0 days.

(21) Appl. No.: 12/353,147

(22) Filed: Jan. 13, 2009

(51) Int. Cl.
*B63C 9/08* (2006.01)

(52) U.S. Cl. ..... 441/106; 441/92

(58) Field of Classification Search ..... 441/88, 441/92–94, 106, 96, 99, 101
See application file for complete search history.

(56) References Cited

U.S. PATENT DOCUMENTS

| | | | | |
|---|---|---|---|---|
| 2,895,147 | A | 7/1959 | Desjarlais et al. | |
| 4,626,221 | A | 12/1986 | Rocco | |
| 5,114,041 | A * | 5/1992 | DiForte | 222/6 |
| 5,178,569 | A | 1/1993 | Wang | |
| D410,132 | S | 5/1999 | Hottenroth | |
| 5,954,556 | A | 9/1999 | Powers | |
| 6,106,348 | A | 8/2000 | Loisel | |
| 6,179,677 | B1 | 1/2001 | Dornier | |
| 6,231,411 | B1 | 5/2001 | Vinay | |
| 6,394,866 | B1 | 5/2002 | Brown | |
| 2005/0118906 | A1 | 6/2005 | Kent | |

* cited by examiner

*Primary Examiner*—Ed Swinehart
(74) *Attorney, Agent, or Firm*—Crossley Patent Law; Mark A. Crossley

(57) ABSTRACT

The swimmer's safety apparatus is worn around a user's waist or proximal thereto and is selectively inflated. The apparatus has a small rigid case with spaced apart rigid housings, each rigid housing holding an inflation device with compressed gas therein. Upon selection, each inflation device is separately released and inflated via a separate rotating handle for each. The compact device is provided in embodiments which can be attached to clothing, included in clothing, or worn about the waist in either attachment fashion or included with an optional belt.

3 Claims, 6 Drawing Sheets

SWIMMER'S SAFETY APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

According to the International Life Saving Federation, every two minutes, somewhere on our Earth, a human being drowns. To provide a numerical perspective, over 250,000 people of our planet drown each year. In the United States alone, 7000 people drown each year, about 20 for each day. For many reasons, life jackets are not worn by most of those. Some reasons for not wearing life jackets include expense, unavailability, movement hindrance, and inconvenience, just to name a few. Among hindrance issues is one of particular note, which is that many who would otherwise wear some form of drowning protection are discouraged in using anything which fits over the head. Performance hindrance, lack of comfort, and appearance are but three of the issues given by those potential wearers. The present apparatus provides a means for saving lives which negates the above listed reasons, and others, for not using a personal swimmer safety device and which provides for selective emergency buoyancy.

FIELD OF THE INVENTION

The present apparatus relates to drowning prevention and more especially to an individual swimmer's safety apparatus which fits around the waist and is used to provide selective emergency inflation in providing buoyancy for a potential water victim.

SUMMARY OF THE INVENTION

The general purpose of the swimmer's safety apparatus, described subsequently in greater detail, is to provide a swimmer's safety apparatus which has many novel features that result in an improved swimmer's safety apparatus which is not anticipated, rendered obvious, suggested, or even implied by prior art, either alone or in combination thereof.

To attain this, the swimmer's safety apparatus is first and foremost a waist worn apparatus. While various embodiments of the apparatus are available which include but are not limited to those which are affixable to belts and clothing, embodiments which are included in various clothing items, and embodiments which are supplied with a belt, all are designed for wear on or near the waist of a user. The apparatus thereby negates many concerns of potential users and in turn invites use in saving lives. The waist worn apparatus is, compared to most life saving devices for swimmers, more compact, especially due to having a rigid case. Also, embodiments which feature only one balloon are even more compact.

The approximate length of the two-balloon embodiments is about 20 centimeters, with a height of about 5 centimeters, and a width of only about 2-3 centimeters. A person who goes in or near the water is then not hindered in wearing virtually any clothing items. Also, a user is not hindered to any significant degree in use of the apparatus in the water. While many boaters refuse to wear life preservers due to movement hindrance and appearance, the present apparatus negates those concerns. Boaters, for example, are much more likely to wear the present apparatus, while their wearing life preservers is proven highly unlikely, and results in countless annual drownings in the United States alone. The apparatus is, especially compared to any swimmer life preserver apparatus, inexpensively produced and sold, further promoting usage. Materials conducive to marine use are employed and include various plastic and other comparable synthetics, as well as metals. The mirror image use of the same lever, valve, balloons and cap in the two-balloon embodiments further reduce production and sales costs. An important advantage of the apparatus is that no draw strings of any kind are used. Nothing is present which can hang on external objects or require that a user search for or being hindered in any way by a pull cord, and the small case allows hydrodynamics.

Thus has been broadly outlined the more important features of the improved swimmer's safety apparatus so that the detailed description thereof that follows may be better understood and in order that the present contribution to the art may be better appreciated.

A first object of the swimmer's safety apparatus is to provide selective emergency buoyancy.

An object of the swimmer's safety apparatus is to negate overhead use and be worn on or proximal to the waist.

Another object of the swimmer's safety apparatus is to be compact.

A further object of the swimmer's safety apparatus is to negate any movement hindrance for a user, when uninflated.

An added object of the swimmer's safety apparatus is to provide an inexpensive emergency buoyancy apparatus.

And, an object of the swimmer's safety apparatus is to provide for inclusion in clothing items.

These together with additional objects, features and advantages of the improved swimmer's safety apparatus will be readily apparent to those of ordinary skill in the art upon reading the following detailed description of presently preferred, but nonetheless illustrative, embodiments of the improved swimmer's safety apparatus when taken in conjunction with the accompanying drawings.

In this respect, before explaining the current embodiments of the improved swimmer's safety apparatus in detail, it is to be understood that the swimmer's safety apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved swimmer's safety apparatus.

It is therefore important that the claims be regarded as including such equivalent constructions insofar as they do not depart from the spirit and scope of the swimmer's safety apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the swimmer's safety apparatus generally designated by the reference number 10 will be described.

Figure 6:
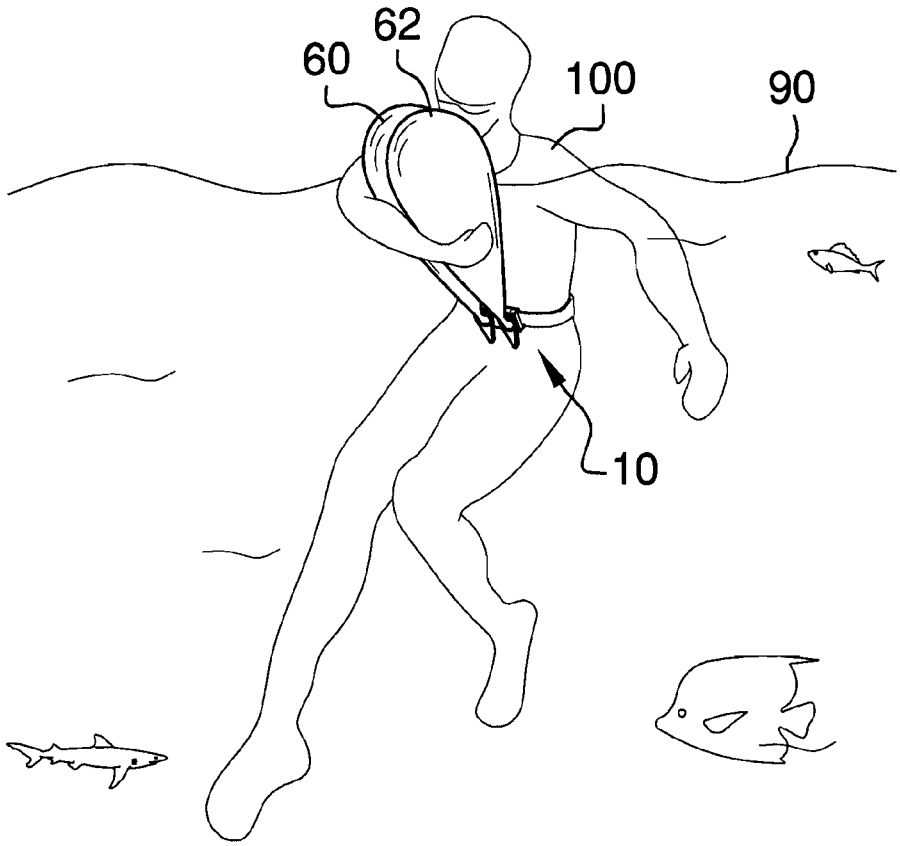
FIG. 6 is a perspective view of the apparatus in use, both balloons inflated.

Referring to FIG. 6, the user 10 (swimmer) has activated the apparatus 10 worn about the user's 10 waist to acquire buoyancy in the water 90. The identical balloons, first balloon 60 and second balloon 62, have been inflated.

Figure 3:
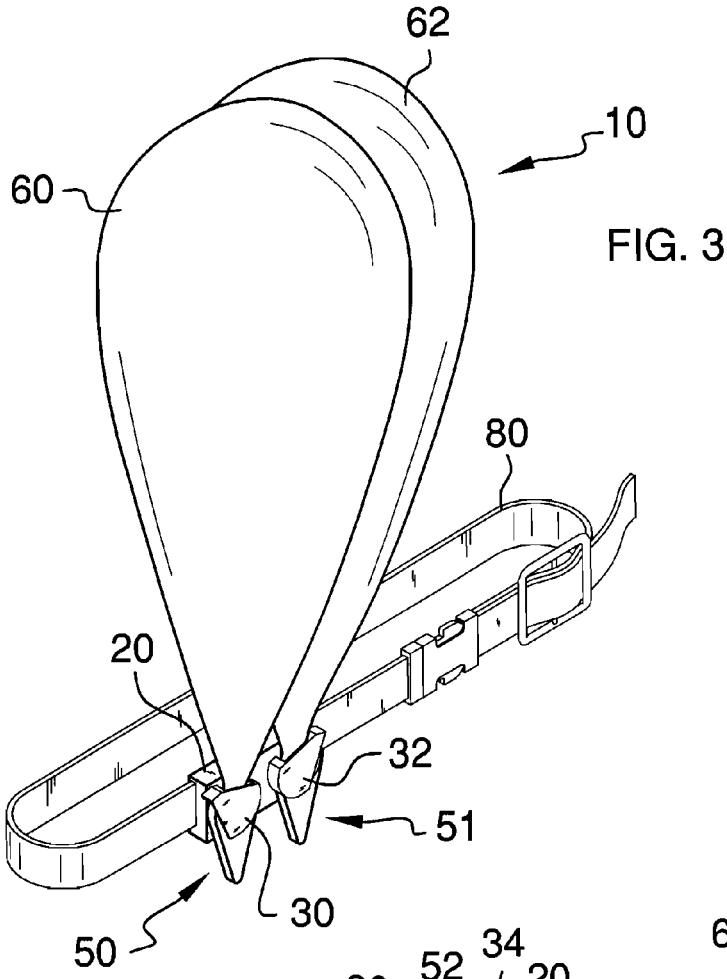
FIG. 3 is a perspective view, with both balloons inflated.

Referring to FIG. 3, the first balloon 60 is released via the selective rotation of the first lever 50 to a vertical position within the first rigid housing 30. The second balloon 62 is inflated via the rotation of the second lever 51 to a vertical position within the second rigid housing 32

Figure 1:
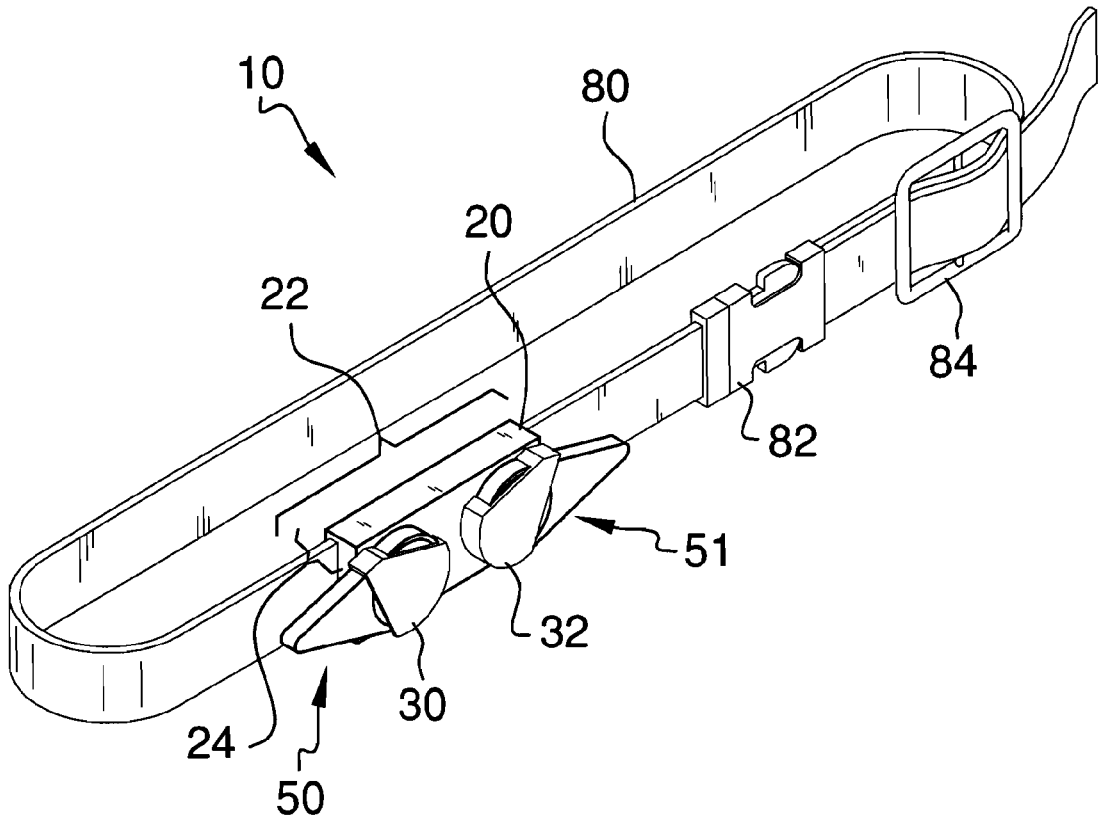
FIG. 1 is a perspective view.
Figure 2:
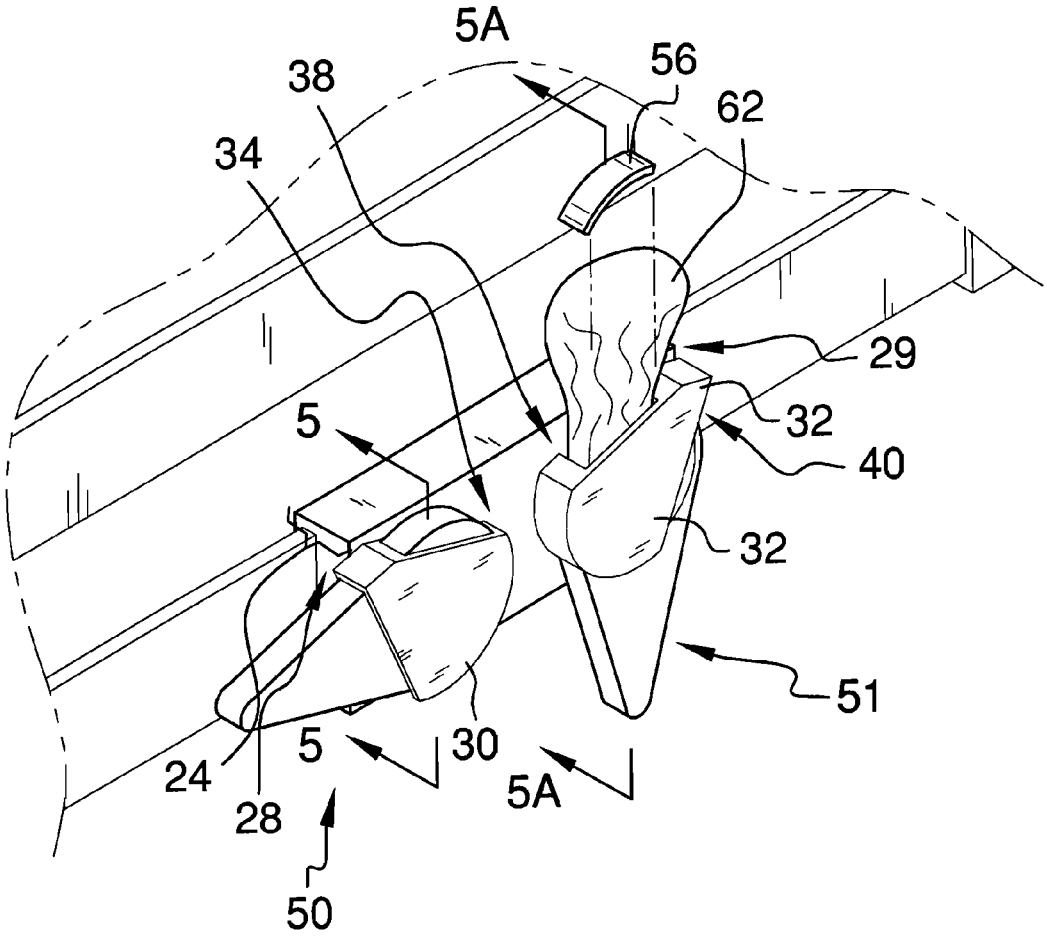
FIG. 2 is a partial perspective view, first lever in horizontal position, second lever in vertical position with cap released and balloon filling.

Referring to FIGS. 1 and 2, the swimmer's safety apparatus 10 partially and optionally comprises the belt 80 for selective wear about a user's 100 waist. The belt 80 includes snap buckle 82 and loop 84. The rigid case 20 is slideably fitted to the belt 80 via the first belt opening 28 and the second belt opening 29. The rigid case 20 has a length 22 of up to 22 centimeters and a width 24 of about 2-3 centimeters.

Figure 4:
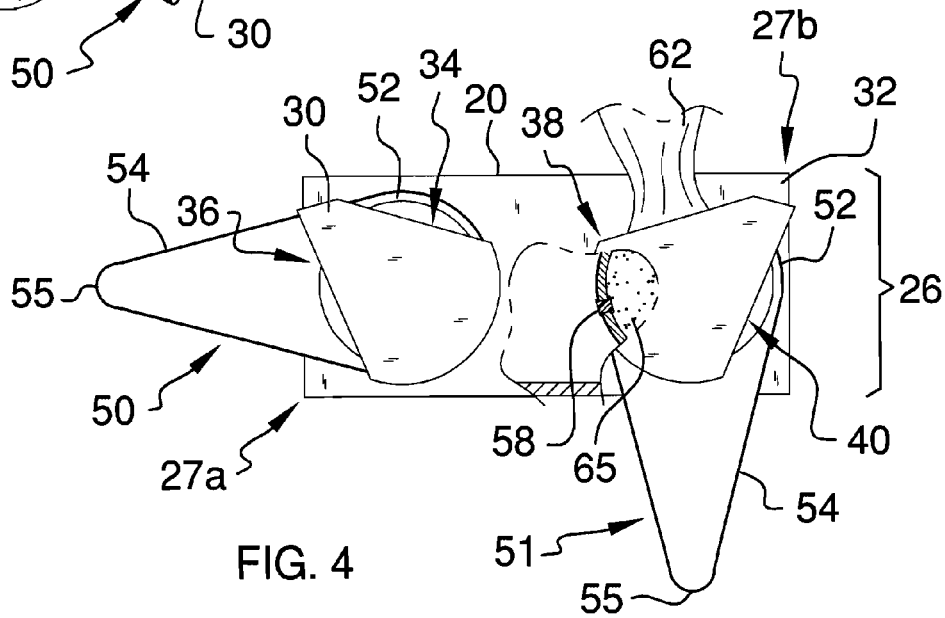
FIG. 4 is a front elevation view of the first and second rigid housings of the rigid case, the first lever in a closed position, the second lever in an open, vertical position, with second balloon inflated.

Referring to FIG. 4, the rigid case 20 has a height 26 of up to about 5 centimeters. The rigid case 20 further has a first end 27*a* spaced apart from a second end 27*b*. The first rigid housing 30 is disposed proximal to the rigid case 20 first end 27*a*. The second rigid housing 32 is disposed proximal to the rigid case 20 second end 27*b*. The first upper slot 34 is disposed within the first rigid housing 30. The first lateral lower slot 36 is disposed within the first rigid housing 30. The first lateral lower slot 36 is spaced apart from the first upper slot 34. The second upper slot 38 is disposed within the second rigid housing 32. The second lateral lower slot 40 is disposed within the second rigid housing 32. The second lateral lower slot 40 is spaced apart from the second upper slot 38. The pair of levers is comprised of the first lever 50 and the second lever 51. The levers are identical. The identical levers are used in a mirrored position within each rigid housing. Each lever is rotatably fitted within each rigid housing.

A lever comprises a hollow circular body 52 with a solid tapered handle 54 extended tangentially from the circular body 52. A rounded end 55 is disposed on the handle 54. A cap 56 is removably fitted to the circular body 52.

Figure 5:
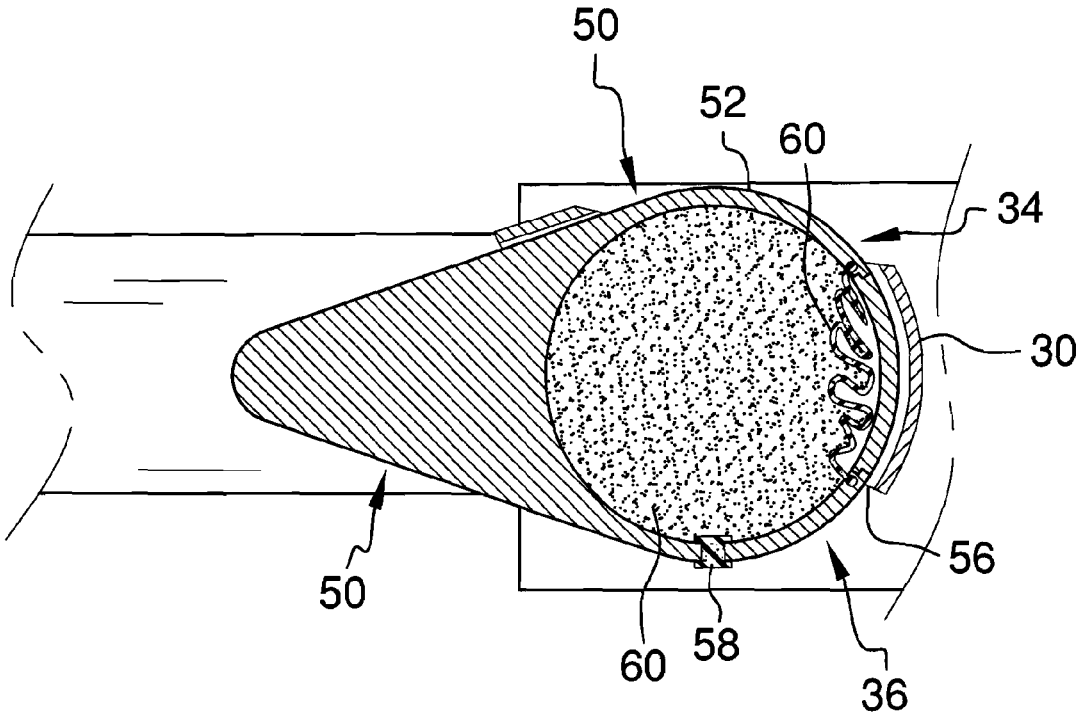
FIG. 5 is a front elevation view of the first lever in a horizontal position, the first balloon and compressed gas trapped within the circular body of the lever.
Figure 5A:
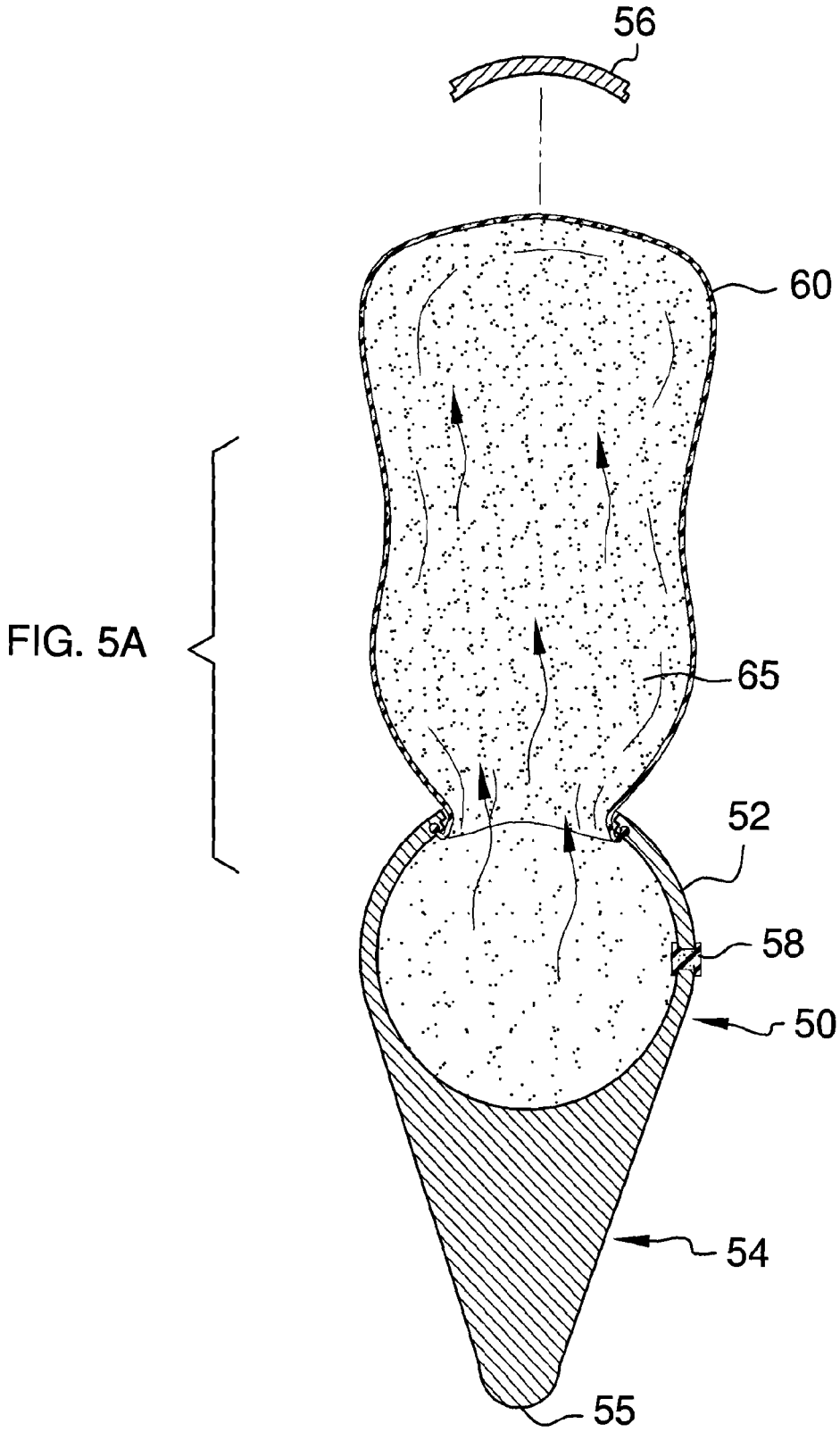
FIG. 5*a* is a front elevation view of the first lever in a vertical position, cap released and balloon inflated.

Referring to FIGS. 5 and 5*a*, the cap 56 is disposed opposite the tapered handle 54. The cap 56 is selectively trapped on the circular body 52 by the first rigid housing 30. Though not shown, the selective operational procedure is identical for the mirror image function of the second lever 51 within the second rigid housing 32. The valve 58 is disposed on the circular body 52. The valve 58 is selectively tripped via rotation of the circular body 52 within the first rigid housing 30. The first balloon 60 is disposed within the circular body 52 of the first lever 50. A chosen compressed gas 65 is disposed within the first balloon 60.

Referring to FIG. 5, the first lever 51, again identical to the second lever 52 but positioned in mirror, is disposed in the horizontal position. The cap 56 is trapped within the first rigid housing 30. The compressed gas 65 and therefore first balloon 60 are trapped within the circular body 52.

Referring to FIG. 5*a*, the first lever 50 is in the vertical position. The valve 58 has been tripped. The cap 56 escaped via rotation of the first lever 50 into the vertical position which leaves the cap 56 exposed for release. The compressed gas 65 both drives the balloon 60 out and fills the balloon 60.

With respect to the above description then, it is to be realized that the optimum dimensional relationships for the parts of the swimmer's safety apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the swimmer's safety apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the swimmer's safety apparatus may be used.

Therefore, the foregoing is considered as illustrative only of the principles of the swimmer's safety apparatus. Further, since numerous modifications and changes will readily occur to those skilled in the art, it is not desired to limit the swimmer's safety apparatus to the exact construction and operation shown and described, and accordingly, all suitable modifications and equivalents may be resorted to, falling within the scope of the swimmer's safety apparatus.

What is claimed is:

1. A swimmer's safety apparatus, comprising, in combination:

a rigid case selectively worn approximately on a user's waist, the rigid case having a first end spaced apart from a second end;

a first rigid housing disposed proximal to the rigid case first end;

a second rigid housing disposed proximal to the rigid case second end;

a first upper slot disposed within the first rigid housing;

a first lateral lower slot disposed within the first rigid housing, the first lateral lower slot spaced apart from the first upper slot;

a second upper slot disposed within the second rigid housing;

a second lateral lower slot disposed within the second rigid housing, the second lateral lower slot spaced apart from the second upper slot;

a pair of identical levers comprising a first lever and a second lever, each lever used in a mirrored position within each rigid housing, each lever rotatably fitted within each rigid housing, each lever comprising:

a hollow circular body;

a solid tapered handle extended tangentially from the circular body;

a rounded end on the handle;

a cap removably fitted to the circular body, the cap disposed opposite the tapered handle, the cap selectively trapped on the circular body by one of the rigid housings;

a valve disposed on the circular body, the valve selectively tripped via rotation of the circular body within one of the rigid housings;

a balloon within the circular body, the balloon pressurized with a compressed gas.

2. A swimmer's safety apparatus, comprising, in combination:

a belt for selective wear about a user's waist;

a rigid case slideably fitted to the belt, the rigid case having a length, a width, and a height, the rigid case having a first end spaced apart from a second end;

a first belt opening laterally disposed on the rigid case first end;

a second belt opening laterally disposed on the rigid case second end;

the rigid case slideably disposed on the belt via the first and second rigid case openings;

a first rigid housing disposed proximal to the rigid case first end;

a second rigid housing disposed proximal to the rigid case second end;

a first upper slot disposed within the first rigid housing;

a first lateral lower slot disposed within the first rigid housing, the first lateral lower slot spaced apart from the first upper slot;

a second upper slot disposed within the second rigid housing;

a second lateral lower slot disposed within the second rigid housing, the second lateral lower slot spaced apart from the second upper slot;

a pair of identical levers comprising a first lever and a second lever, each lever used in a mirrored position within each rigid housing, each lever rotatably fitted within each rigid housing, each lever comprising:

a hollow circular body;

a solid tapered handle extended tangentially from the circular body;

a rounded end on the handle;

a cap removably fitted to the circular body, the cap disposed opposite the tapered handle, the cap selectively trapped on the circular body by one of the rigid housings;

a valve disposed on the circular body, the valve selectively tripped via rotation of the circular body within one of the rigid housings;

a balloon within the circular body, the balloon pressurized with a compressed gas.

3. The apparatus according to claim 2 wherein the length further comprises about 20 centimeters;

the width further comprises about 2-3 centimeters;

the height further comprises about 5 centimeters.

* * * * *